US005968703A

United States Patent [19]

Maniar et al.

[11] Patent Number: 5,968,703

[45] Date of Patent: Oct. 19, 1999

[54] CARRIER COMPOSITION AND PROCESSES THEREOF

[75] Inventors: Deepak R. Maniar, Penfield; John T. Bickmore, Rochester, both of N.Y.

[73] Assignee: Xerox Corporation, Stamford, Conn.

[21] Appl. No.: 09/087,883

[22] Filed: Jun. 1, 1998

[51] Int. Cl.[6] ..... G03G 9/10

[52] U.S. Cl. ..... 430/122; 430/137

[58] Field of Search ..... 430/108, 137, 430/122

[56] References Cited

U.S. PATENT DOCUMENTS 4,233,387 11/1980 Mammino et al. ..... 430/137

4,478,925 10/1984 Miskinis ..... 430/108

5,569,572 10/1996 Laing et al. ..... 430/137

5,882,834 3/1999 Maniar ..... 430/137

*Primary Examiner*—John Goodhow

*Attorney, Agent, or Firm*—John L. Haack

[57] ABSTRACT

A process including:

blending carrier particles;

separating the resulting blended carrier particles from fine particles formed in blending; and blending the resulting blended carrier particles with toner particles to form a two component developer.

21 Claims, 2 Drawing Sheets

CARRIER COMPOSITION AND PROCESSES THEREOF

REFERENCE TO COPENDING APPLICATIONS AND ISSUED PATENTS

Attention is directed to commonly owned and assigned U.S. Pat. Nos. 5,674,656, issued Oct. 7, 1997, entitled "Processes for Stabilizing Developer Chargability and Imaging Processes Thereof", which patent discloses a process for controlling $A_t$ transience comprising: providing in a developer housing, a two component developer composition comprising toner particles comprised of a resin, a pigment, a mixture of at least two charge additives, and unpreconditioned coated carrier core particles, wherein the developer is prepared by combining and thereafter blending a mixture of from 1 to about 10 parts by weight of toner particles with from about 100 parts by weight of carrier particles for about 10 minutes to about 30 minutes until an $A_t$ value of from about 60 to about 100 is attained; and forming and thereafter developing electrostatographic latent images on a photoconductive member in a two component development electrostatographic imaging apparatus with the developer composition; wherein the developer composition has an $A_t$ transient of less than about 20 relative units; U.S. Pat. No. 4,614,165, issued Sep. 30, 1986, entitled "Extended Life Development System", wherein there is disclosed an apparatus which develops an electrostatic latent image recorded on a photoconductive member employed in an electrophotographic printing machine having a finite, usable life, which apparatus employs a developer material which ages during the life of the electrophotographic printing machine, and thus a continuous supply of carrier granules is furnished to the developer material; U.S. Pat. No. 4,948,686, issued Aug. 14, 1990, entitled "Process For Forming Two Color Images", discloses a development process using a specific coated carrier with a coating weight of about 0.05 weight percent of the carrier core; U.S. Pat. No. 4,678,734, issued Jul. 7, 1987, to Laing et al., entitled "Process For Developer Composition", discloses a process for making a developer composition comprising: 1) providing carrier particles having a core with a coating thereover; 2) introducing the carrier particles into a blending apparatus; 3) adding to the blending apparatus fine toner particles with a diameter of from about 2 to about 10 microns, these particles being comprised of toner resin particles, pigment particles, and a charge enhancing additive; 4) effecting blending for a period of time sufficient to enable the classified toner particles to alter the tribogenerating ability of the surface of the carrier particles and become embedded therein; 5) subsequently adding to the resulting blended mixture toner particles of a diameter of from about 2 to about 18 microns, and which particles are comprised of toner resin, pigment particles, and a charge enhancing additive; and 6) blending for a period of from about 1 minute to about 5 minutes.

Attention is directed to commonly owned and assigned copending Application Number, U.S. Ser. No. 08/145,118 (D/93570) filed Nov. 11, 1993, now U.S. Pat. No. 5,882,834 entitled "Method of Making Developer with Stable Triboelectric Charging Properties", wherein there is disclosed a method of preparing a developer composition comprising: 1) blending carrier particles with finely divided toner particles, wherein blending is carried out for a period of time sufficient to enable the toner particles to alter the tribocharging ability of the carrier particles and become embedded therein; 2) dividing the blend of toner particles and carrier particles into coarse particles and fine particles; and 3) blending the coarse particles with toner particles.

The disclosures of each the above mentioned patents and copending applications are incorporated herein by reference in their entirety. The appropriate components and processes of these patents may be selected for the toners and processes of the present invention in embodiments thereof.

BACKGROUND OF THE INVENTION

The present invention is generally directed to developer compositions and processes for the preparation thereof, and more specifically, the present invention is directed to developer compositions with high conductivities, for example, from about $10^{-12}$ (ohm-cm)$^{-1}$ to about $10^{-7}$ (ohm-cm)$^{-1}$. More specifically the present invention relates to carrier and developer preparative processes, comprising, for example, preconditioning resin coated carrier particles to achieve highly desirable developer, development, and image properties, for example, high efficiency donor roll reload efficiencies at time zero(t=0).

PRIOR ART

U.S. Pat. No. 5,569,572, issued Oct. 29, 1996, to Laing, et al., discloses a process for the preparation of developer compositions comprising providing a first developer comprised of carrier and first toner comprised of resin, pigment, polyolefin, compatibilizer, charge control agent, and surface additive, and adding thereto a second replenisher comprised of carrier, and second toner comprised of resin, pigment, polyolefin, compatibilizer, charge control agent, and surface additive, and wherein the surface additive of the second toner is present in a lesser amount than the surface additive of the first toner.

The aforementioned patent is incorporated by reference herein in its entirety. The following are also of interest.

Developer compositions with charge enhancing additives, which impart a positive charge to the toner resin, are also known. Thus, for example, there is described in U.S. Pat. No. 3,893,935 the use of quaternary ammonium salts as charge control agents for electrostatic toner compositions. There are also described in U.S. Pat. No. 2,986,521 reversal developer compositions comprised of toner resin particles coated with certain finely divided colloidal silica. According to the disclosure of this patent, the development of electrostatic latent images on negatively charged surfaces is accomplished by applying a developer composition having a positively charged triboelectric relationship with respect to the colloidal silica.

Also, there is disclosed in U.S. Pat. No. 4,338,390, the disclosure of which is totally incorporated herein by reference, developer compositions containing as charge enhancing additives organic sulfate and sulfonates, which additives can impart a positive charge to the toner composition. Further, there is disclosed in U.S. Pat. No. 4,298,672, the disclosure of which is totally incorporated herein by reference, positively charged toner compositions with resin particles and pigment particles, and as charge enhancing additives alkyl pyridinium compounds. Additionally, other documents disclosing positively charged toner compositions with charge control additives include U.S. Pat. Nos. 3,944,493; 4,007,293; 4,079,014; 4,394,430 and 4,560,635 which illustrates a toner with a distearyl dimethyl ammonium methyl sulfate charge additive.

Moreover, toner compositions with negative charge enhancing additives are known, reference for example U.S. Pat. Nos. 4,411,974 and 4,206,064, the disclosures of which are totally incorporated herein by reference. The '974 patent discloses negatively charged toner compositions comprised of resin particles, pigment particles, and as a charge enhancing additive ortho-halo phenyl carboxylic acids. Similarly, there are disclosed in the '064 patent toner compositions with chromium, cobalt, and nickel complexes of salicylic acid as negative charge enhancing additives.

There is illustrated in U.S. Pat. No. 4,404,271, a complex system for developing electrostatic images with a toner which contains a metal complex represented by the formula in column 2, for example, and wherein ME can be chromium, cobalt or iron. Additionally, other patents disclosing various metal containing azo dyestuff structures wherein the metal is chromium or cobalt include U.S. Pat. Nos. 2,891,939; 2,871,233; 2,891,938; 2,933,489; 4,053,462 and 4,314,937. Also, in U.S. Pat. No. 4,433,040, the disclosure of which is totally incorporated herein by reference, there are illustrated toner compositions with chromium and cobalt complexes of azo dyes as negative charge enhancing additives.

There remains a need for an economical, efficient, and environmentally acceptable method for the preparation of developers with, for example, high and stable conductivity, superior flow, environmental stability, charging properties, and imaging processes thereof.

The developer compositions and processes of the present invention are useful in many applications including imaging and printing processes, including color printing, for example, electrostatographic, such as in xerographic printers and copiers, including digital systems.

SUMMARY OF THE INVENTION

Embodiments of the Present Invention, Include:

A process comprising blending resin coated carrier particles;

separating the resulting blended carrier particles from fine particles formed while blending; and blending the blended carrier particles with toner particles to form a two component developer;

Providing a process comprising: blending coated carrier particles with first toner particles, wherein blending is carried out for a period of time sufficient to enable the first toner particles to alter the tribocharging ability of the carrier particles and become embedded on the surface of the carrier coating; dividing the blend of first toner particles and carrier particles into coarse particles and fine particles; and blending the coarse particles with second toner particles to form a two component developer;

Providing developer compositions with conductivities of from about $10^{-12}$ (ohm-cm)$^{-1}$ to about $10^{-7}$ (ohm-cm)$^{-1}$; and Providing developer compositions with high initial or time zero(t=0)reload efficiencies.

DETAILED DESCRIPTION OF THE INVENTION

Figure 1:
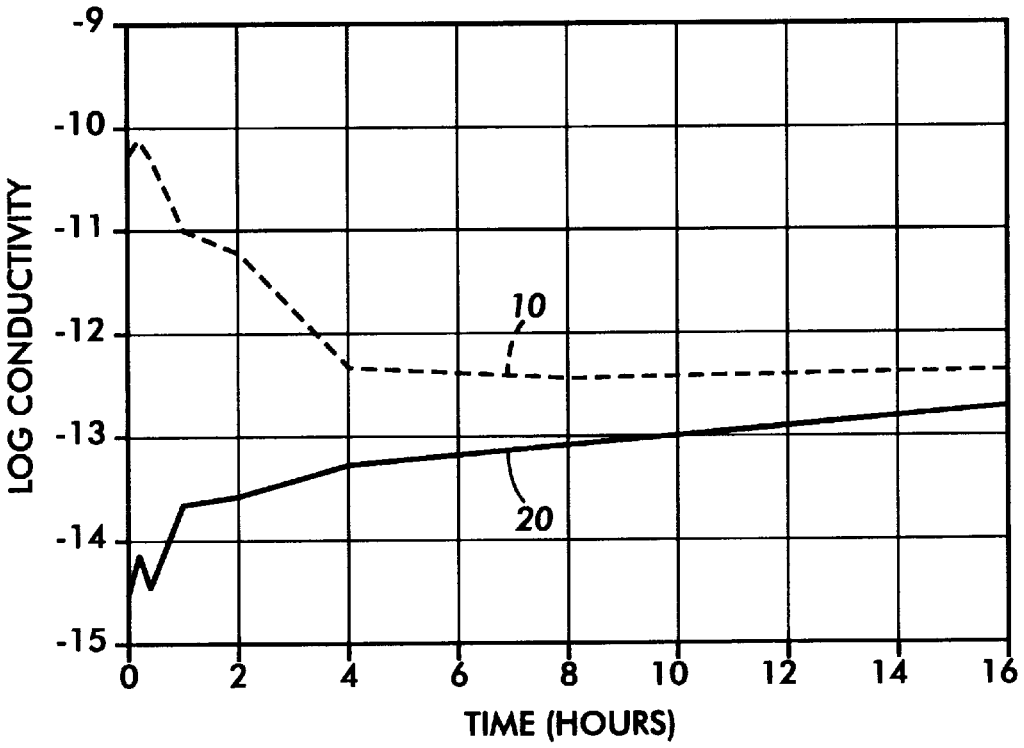
FIG. 1 shows the conductivity over time of preconditioned carrier particles of the present invention compared to unconditioned carrier particles.

The present invention provides, in embodiments:

A process comprising:

blending resin coated or uncoated carrier particles;

separating the resulting blended carrier particles from fine particles formed while blending; and blending the blended carrier particles with toner particles to form a two component developer.

Two-component xerographic developers can be made either insulating or conducting depending upon whether the carrier particles are conductive, reference for example, the Xerox Corporation Model 1090 series which employs partially coated carriers having conductivities of about $10^{-10}$ (ohm-cm)$^{-1}$ and completely coated carriers of the Xerox Corporation Model 5090 series with conductivities of less than about $10^{-14}$ (ohm-cm)$^{-1}$. Developer conductivity increases the rate of solid-area development(SAD) and thus is a means of improving "fill" of extended areas in magnetic brush development. In hybrid scavengeless development (HSD) and hybrid jumping development (HJD), a magnetic brush deposits toner on a donor roller, and this donor subsequently develops the image, reference for example the Xerox Corporation DOCUCENTRE® 265 development system. Developer conductivity is advantageous in these systems primarily because it increases the rate of toner deposit on the donor roller. In order to produce uniform extended images with HSD or HJD it is preferable that the donor be loaded to a near-equilibrium value in one rotation against the magnetic brush, otherwise an extended-image area will be developed more heavily at the edge where the donor loading is at an equilibrium value than at an internal area where the donor was stripped in developing the upstream edge of the image and then not fully reloaded. This could result in an image density gradient on a line corresponding to the last area developed by a fully-loaded donor and the beginning of the area developed by a partially-loaded donor. This line or area of development discontinuity constitutes an image defect called a "reload defect". Reload defects are measured in terms of optical density differences across this line of demarcation. Alternatively, a laboratory method of defining a reload defect is to measure the electrical potential above the donor due to the charge of the toner layer. When the potential of the donor, after one pass across the magnetic brush, is equal to the potential after many passes, there will be no reload defect. This condition defines ideal or 100 percent reload. If the potential after one pass is, for example, about 50 percent of the equilibrium potential, the reload would be about 50 percent. The ultimate measure of reload is obtained from actual images and not extrapolation from electrostatic measurements. While a complete understanding of the relationship between optical density measurements of reload and electrostatic measurements of reload is not available since the relationship depends upon a large number of factors correlation is apparent. For example, it has been observed that developers producing reload of about 50% or greater as measured by the electrostatic method generally produce little or no observable reload defect, while developers with reload of about 40% or less generally produce observable defects. The reason that donor potential reload measurements of only about 50% may result in no visible reload defects is believed to be related to differences in the charge-to-mass ratio of toner deposited on the donor after the first development pass compared to the charge-to-mass ratio of toner after many passes. As the donor is re-developed in each pass by the magnetic brush, low-charge toner is scavenged and replaced by higher charge-to-mass toner. Thus, first-pass toner may produce a dense image even though its charge-to-mass is lower than multi-pass toner.

The present invention provides developers wherein the reload defect is not present even on the first copies produced from a fresh developer. Without employing the present invention to developer compositions, many otherwise excellent developer compositions may have a serious reload defect on first use of a fresh developer that persists for many thousands of copies and is therefore unsuitable for general use.

The blending or preconditioning of the resin coated carrier particles only, that is, blending a measured amount of coated carrier, can be accomplished, for example, in about 5 minutes to about 4 hours thereby increasing the carrier bulk conductivity, for example, from less than about $10^{-14}$ (ohm-cm)$^{-1}$ to about $10^{-13}$ (ohm-cm)$^{-1}$ and above. In another embodiment, blending the coated carrier particles with toner to form a developer is carried out for a period of time sufficient, for example, from about 5 minutes to about 4 hours, to achieve a preconditioned carrier with a conductivity value of from about $10^{-12}$ (ohm-cm)$^{-1}$ to about $10^{-7}$ (ohm-cm)$^{-1}$. Although not wanting to be limited by theory it is believed that the preconditioning process can remove resin coating from the asperities on the carrier surface thereby allowing conductive contact between carrier particles.

The separation of the resulting blended carrier particles from fine particles, such as the aforementioned asperities and polymer particles that have been dislodged from the coated carrier surface can be accomplished with a vibrating screener or a comparable sieving device and related machinery for separating fine particles from coarse particulate material. The fine particles can comprise particulates from about 0.1 microns to about 5.0 micron arising from the metallic asperities and resin coating being mechanically removed from the surface to the coated carrier particles.

The resulting developer formed from blending the preconditioned carrier with toner particles has improved reload efficiency at time zero as determined by improved and substantially constant printed image density or from donor potential reload measurements, for example, of over 50% compared to reload measurements of less than 50% for a developer prepared without blending and separating the blended coated carrier particles, that is un-preconditioned or unconditioned carrier. Blending of coated carrier particles can be readily and economically accomplished with either a low or high energy mixer, for example, low energy mixers include Munson mixers or roll mills, and high energy mixers include Littleford blenders, and the like blenders. A high intensity mixer or blender is preferred when reduced time of processing or high product uniformity is desired.

The present invention provides, in embodiments, a process comprising:

blending coated carrier particles with first toner particles, wherein blending is carried out for a period of time sufficient to enable the first toner particles to alter the tribocharging ability of the carrier particles and become embedded or impacted on the surface of the carrier coating;

dividing or separating the blend of first toner particles and carrier particles into coarse particles and fine particles; and blending the coarse particles with second toner particles to form a two component developer.

As in the aforementioned process that preconditions the carrier particles without a first toner present, the resulting developer obtained from preconditioning the carrier particles with toner particles present, for example, toner fines with particles of volume average diameter of from about 3 to about 5 microns, followed by separation of the preconditioned carrier particles from fines material, also has improved reload efficiencies at time zero as determined by improved and substantially constant printed image density compared to variable image density at time zero for a developer prepared without blending and dividing coated carrier particles with first toner particles. Blending of coated carrier particles with the first toner particles can be for a period of time of from about 5 to about 60 minutes. The blend time can depend upon various factors such as the coating thickness, the intensity of the blender, and the extent of toner impaction on the coated carrier surface desired. Carrier particles with lower resin coating weights can typically be accomplished in less time compared to a high coating weight developer. Dividing the blend of first toner particles and coated carrier particles can accomplished with, for example, a vibrating screener capable of continuously handling mixed particle sizes and wherein the coarse particles are from about 10 to about 100 microns. The efficiency and the quality of the divided blend depends to a large extent on the size and the type of coated carrier selected. Blending of the coarse particles with the second toner particles to form a two component developer can also be accomplished with high or low intensity mixers for a period of time of from about 2 to about 20 minutes.

The present invention provides, in embodiments, an imaging process comprising employing a carrier or developer obtained in accordance with the aforementioned preconditioning processes in a known conductive magnetic brush development system, for example, as found in a Xerox Corporation Model 1075, wherein a high development rate is enabled by the enhanced carrier conductivity and which conductivity is believed to be attributable to the preconditioning process. The imaging process provides excellent image fill from a first imaging use or time zero (t=0) use. The imaging process provides improved image fill, for example, from poor using an unpreconditioned carrier where print quality defects such as deletions are observed, to excellent using preconditioned carriers or developers of the present invention where substantially no deletions are observed at time zero.

The carrier coating can be any suitable known polymer such as polyesters, polyester-urethanes, polyurethanes, cross-linked polyurethanes, polyalkylmethacrylates, fluorinated polymers, polystyrenes, styrene-acrylate copolymers, mixtures thereof, and the like materials, including polymethylmethacrylates, polyvinylidene fluorides, and the like materials. In embodiments, the carrier coating selected is a polyester-urethane polymer, for example, ENVIRO-CON® polymers available from PPG Industries, Inc., such as in amounts of about 0.1 to about 1.0 weight percent, and more preferably in amounts of about 0.4 to about 0.5 weight percent based on the weight of the carrier particles. The carrier coating can further comprise additional known performance additives, such as conductive and non conductive additives, including but not limited to colored and colorless pigments, organic and inorganic fillers, dyes, such as dye compounds, and mixtures thereof, and more specifically, such as carbon black, magnetites, copper iodides, fillers including glass, minerals, and the like materials. The carrier coating can comprise from about 0.001 to about 10, and preferably from about 0.025 to about 3 weight percent of the carrier particles of a mixture of polymers or copolymers, such as a polymethylmethacrylate and polyester-urethane in a weight ratio of from about 20:80 to about 80:20. Alternatively, a single polymer can be used in the polymer coating in amounts of about 0.025 to about 3 weight percent, for example a polyester-urethane, to provide an insulting carrier which could be rendered conductive when employed in the process of the present invention.

The tribocharging ability of the coated carrier particle is for example from about 20 to about 80 microcoulombs per gram before blending with the first toner, preferably from about 20 to about 60, and is more preferably from about 20 to about 50 microcoulombs per gram after blending with the first toner. Similarly, the carrier tribo after blending with the second toner is in a comparable range. The process of the present invention does not appear to adversely effect the tribocharging ability of the carrier or toners used in developing images in that the resulting preconditioned carrier and resulting developers have tribo- values well within acceptable performance ranges.

When preconditioning of the coated carriers employs a toner, the first toner particles can comprise from about 0.1 to about 10 weight percent of the total weight of the carrier particles and can be finely divided toner particles with a volume average diameter of from about 3 to about 30 microns. The first and second toners employed can be conventional and known toner compositions, which include a resin, and a colorant, as well as other toners, such as waste toners or toners formulated with conductivity or tribo enhancing additives. The second toner is preferably a toner that will be selected for image development. The colorant can be selected from known colorants such as carbon blacks, magnetites, cyan pigments, magenta pigments, yellow pigments, red pigments, green pigments, blue pigments, brown pigments, mixtures thereof, and the like colors. The pigments and other colorants can be present in the toner in amounts of from about 2 to about 10 weight percent based on the total weight of the toner.

Suitable resins for the toner are for example styrene-butadienes, styrene acrylates, styrene methacrylates, polyesters, and the like polymers, and mixtures thereof and other known resins. The first toner can be selected in amounts, for example, from about 0.1 to about 10 weight percent, and the second toner can also be selected in amounts, for example, from about 0.1 to about 10 weight percent.

The first and second toners can further include charge additives materials or compounds present in an amount of from about 0.05 to about 5 weight percent based on the weight of the toner, and wherein the first and second toner have an admix time of from about 1 to about 14 seconds and a triboelectric charge of from about 10 to about 40 microcoulombs per gram. The resulting developer materials can have a conductivity of from about $10^{-12}$ (ohm-cm)$^{-1}$ to about $10^{-7}$ (ohm-cm)$^{-1}$.

Toner compositions can be prepared by a number of known methods, such as admixing and heating resin particles such as styrene butadiene copolymers, colorant particles such as magnetite, carbon black, or mixtures thereof, and cyan, yellow, magenta, green, brown, red, or mixtures thereof, and preferably from about 0.5 percent to about 5 percent of charge enhancing additives in a toner extrusion device, such as the ZSK53 available from Werner Pfleiderer, and removing the formed toner composition from the device. Subsequent to cooling, the toner composition is subjected to grinding utilizing, for example, a Sturtevant micronizer for the purpose of achieving toner particles with a volume median diameter of less than about 25 microns, and preferably of from about 6 to about 12 microns, which diameters are determined by a Coulter Counter. Subsequently, the toner compositions can be classified utilizing, for example, a Donaldson Model B classifier for the purpose of removing toner fines, that is toner particles less than about 4 microns volume median diameter. Alternatively, the toner compositions are ground with a fluid bed grinder equipped with a classifier wheel and then classified.

Illustrative examples of resins suitable for toner and developer compositions of the present invention include linear or branched styrene acrylates, styrene methacrylates, styrene butadienes, vinyl resins, including linear or branched homopolymers and copolymers of two or more vinyl monomers; vinyl monomers include styrene, p-chlorostyrene, butadiene, isoprene, and myrcene; vinyl esters like esters of monocarboxylic acids including methyl acrylate, ethyl acrylate, n-butyl acrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; and the like. Preferred toner resins include styrene butadiene copolymers, mixtures thereof, and the like. Other preferred toner resins include styrene/n-butyl acrylate copolymers, PLIOLITES®; suspension polymerized styrene butadienes, reference U.S. Pat. No. 4,558,108, the disclosure of which is totally incorporated herein by reference.

In the toner compositions, the resin particles are present in a sufficient but effective amount, for example from about 70 to about 90 weight percent. Thus, when 1 percent by weight of the charge enhancing additive is present, and 10 percent by weight of pigment or colorant, such as carbon black, is contained therein, about 89 percent by weight of resin is selected. Also, the charge enhancing additive may be coated on the pigment particle. When used as a coating, the charge enhancing additive is present in an amount of from about 0.1 weight percent to about 5 weight percent, and preferably from about 0.3 weight percent to about 1 weight percent.

Numerous well known suitable colorants, such as pigments or dyes can be selected as the colorant for the toner particles including, for example, carbon black like REGAL 330®, nigrosine dye, aniline blue, magnetite, or mixtures thereof. The pigment, which is preferably carbon black, should be present in a sufficient amount to render the toner composition highly colored. Generally, the pigment particles are present in amounts of from about 1 percent by weight to about 20 percent by weight, and preferably from about 2 to about 10 weight percent based on the total weight of the toner composition; however, lesser or greater amounts of pigment particles can be selected.

When the pigment particles are comprised of magnetites, thereby enabling magnetic ink character recognition(MICR) toners in some instances if desired, which magnetites are a mixture of iron oxides ($FeO.Fe_2O_3$) including those commercially available as MAPICO BLACK®, they are present in the toner composition in an amount of from about 10 percent by weight to about 70 percent by weight, and preferably in an amount of from about 10 percent by weight to about 50 percent by weight. Mixtures of carbon black and magnetite with from about 1 to about 15 weight percent of carbon black, and preferably from about 2 to about 6 weight percent of carbon black, and magnetite, such as MAPICO BLACK®, in an amount of, for example, from about 5 to about 60, and preferably from about 10 to about 50 weight percent can be selected.

Colorant includes pigments, dyes, mixtures thereof, mixtures of pigments, mixtures of dyes, and the like.

There can also be blended with the toner compositions external additive particles including flow aid additives, which additives are usually present on the surface thereof. Examples of these additives include colloidal silicas, such as AEROSIL®, metal salts and metal salts of fatty acids inclusive of zinc stearate, aluminum oxides, cerium oxides, and mixtures thereof, which additives are generally present in an amount of from about 0.1 percent by weight to about 10 percent by weight, and preferably in an amount of from about 0.1 percent by weight to about 5 percent by weight. Several of the aforementioned additives are illustrated in U.S. Pat. Nos. 3,590,000 and 3,800,588, the disclosures of which are totally incorporated herein by reference.

With further respect to the toners used in conjunction with the present invention, colloidal silicas, such as AEROSIL®, can be surface treated with the charge additives in an amount of from about 1 to about 30 weight percent and preferably 10 weight percent followed by the addition thereof to the toner in an amount of from 0.1 to 10 and preferably 0.1 to 1 weight percent.

Also, there can be included in the toner compositions low molecular weight waxes, such as polypropylenes and polyethylenes commercially available from Allied Chemical and Petrolite Corporation, EPOLENE N-15® commercially available from Eastman Chemical Products, Inc., VISCOL 550-P®, a low weight average molecular weight polypropylene available from Sanyo Kasei K.K., and similar materials. The commercially available polyethylenes selected have a molecular weight of from about 1,000 to about 1,500, while the commercially available polypropylenes utilized for the toner compositions are believed to have a molecular weight of from about 4,000 to about 5,000. Many of the polyethylene and polypropylene compositions useful in the present invention are illustrated in British Pat. No. 1,442,835, the disclosure of which is totally incorporated herein by reference.

The low molecular weight wax materials are optionally present in the toner composition or the polymer resin beads of the present invention in various amounts, however, generally these waxes are present in the toner composition in an amount of from about 1 percent by weight to about 15 percent by weight, and preferably in an amount of from about 2 percent by weight to about 10 percent by weight and may in embodiments function as fuser roll release agents.

Encompassed within the scope of the present invention are colored toner and developer compositions comprised of toner resin particles, carrier particles, charge enhancing additives, and as pigments or colorants red, blue, green, brown, magenta, cyan and/or yellow particles, as well as mixtures thereof. More specifically, with regard to the generation of color images utilizing a developer composition with charge enhancing additives, illustrative examples of magenta materials that may be selected as pigments include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyan materials that may be used as pigments include copper tetra-4-(octadecyl sulfonamido) phthalocyanine, X-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, and Permanent Yellow FGL. The aforementioned pigments are incorporated into the toner composition in various suitable effective amounts providing the objectives of the present invention are achieved. In one embodiment, these colored pigment particles are present in the toner composition in an amount of from about 2 percent by weight to about 15 percent by weight calculated on the weight of the toner resin particles.

For the formulation of developer compositions, there are mixed with the toner particles carrier components, particularly those that are capable of triboelectrically assuming an opposite polarity to that of the toner composition. Accordingly, the carrier particles are selected to be of a negative polarity enabling the toner particles, which are positively charged, to adhere to and surround the carrier particles. Illustrative examples of carrier particles include iron powder, steel, nickel, iron, ferrites, including copper zinc ferrites, and the like. Additionally, there can be selected as carrier particles nickel berry carriers as illustrated in U.S. Pat. No. 3,847,604, the disclosure of which is totally incorporated herein by reference particles used the aforementioned coating composition, the coating generally containing terpolymers of styrene, methylmethacrylate, and a silane, such as triethoxy silane, reference U.S. Pat. Nos. 3,526,533, 4,937,166, and 4,935,326, the disclosures of which are totally incorporated herein by reference, including for example KYNAR® and polymethylmethacrylate mixtures (40/60). Coating weights can vary as indicated herein; generally, however, from about 0.3 to about 2, and preferably from about 0.5 to about 1.5 weight percent coating weight is selected.

Furthermore, the diameter of the carrier particles, is generally from about 35 microns to about 1,000 microns, and in embodiments from 50 to about 175 microns thereby permitting them to possess sufficient density and inertia to avoid adherence to the electrostatic images during the development process. The carrier component can be mixed with the toner composition in various suitable combinations. Excellent results are obtained when about 1 to about 5 parts toner to about 10 parts to about 200 parts by weight of carrier are selected.

The toner composition used in conjunction with the coated or uncoated carriers of the present invention can be prepared by a number of known methods as indicated herein including extrusion melt blending the toner resin particles, pigment particles or colorants, and a charge enhancing additive, followed by mechanical attrition. Other methods include those well known in the art such as spray drying, melt dispersion, emulsion aggregation, and extrusion processing. Also, as indicated herein the toner composition without the charge enhancing additive in the bulk toner can be prepared, followed by the addition of charge additive surface treated colloidal silicas.

The toner and developer compositions may be selected for use in electrostatographic imaging apparatuses containing therein conventional photoreceptors providing that they are capable of being charged positively or negatively. Thus, the toner and developer compositions can be used with layered photoreceptors that are capable of being charged negatively, such as those described in U.S. Pat. No. 4,265,990, the disclosure of which is totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys.

The toner compositions are usually jetted and classified subsequent to preparation to enable toner particles with a preferred average diameter of from about 3 to about 25 microns, more preferably from about 4 to about 12 microns, and most preferably from about 5 to about 8 microns. Also, the toner compositions preferably possess a triboelectric charge of from about 0.1 to about 2 femtocoulombs per micron as determined by the known charge spectrograph. Admix time for toners are preferably from about 5 seconds to 1 minute, and more specifically from about 5 to about 15 seconds as determined by the known charge spectrograph. These toner compositions with rapid admix characteristics enable, for example, the development of images in electrophotographic imaging apparatuses, which images have substantially no background deposits thereon, even at high toner dispensing rates in some instances, for instance exceeding 20 grams per minute; and further, such toner compositions can be selected for high speed electrophotographic apparatuses, that is those exceeding 70 copies per minute.

Also, the toner compositions, in embodiments, of the present invention possess desirable narrow positive charge distributions, optimal charging triboelectric values, preferably of from about 10 to about 40, and more preferably from about 10 to about 35 microcoulombs per gram as determined by the known Faraday Cage methods with from about 0.1 to about 5 weight percent in one embodiment of the charge enhancing additive; and rapid admix charging times as determined in the charge spectrograph of less than 15 seconds, and more preferably in some embodiments from about 1 to about 14 seconds.

The invention will further be illustrated in the following non limiting Examples, it being understood that these Examples are intended to be illustrative only and that the invention is not intended to be limited to the materials, conditions, process parameters, and the like, recited herein. Parts and percentages are by weight unless otherwise indicated.

EXAMPLE I

Preparation of Coated Carrier

Coated carriers were prepared by coating a suitable polymer or mixture of polymers, for example, by solution or powder coating methods, onto metal core particles then heat fused in an oven or a kiln, reference for example commonly owned and assigned U.S. Pat. No. 4,937,166, to Creatura et al., which discloses polymer coated carrier particles for electrophotographic developers, the disclosure of which is incorporated by reference herein in its entirety. In an illustrative example, ENVIROCRON® a polyester urethane powder, commercially available from P.P.G. Industries, Inc., was premixed in an 80:20 weight ratio in a blender with a polymethylmethacrylate polymer containing about 20 weight percent carbon black. The resulting premixture of polymers was then admixed with 65 micron diameter steel core particles, for example, as commercially available from Hoeganaes Inc., in a Munson blender at one(1) weight percent coating with respect to the weight of the core particles. The materials were admixed for about 30 minutes until the cores were uniformly coated with polymers. The polymer coated core particles were then passed through a rotary kiln operating at about 390° F. The polymer coating thereby fused to core particles. The resulting fuse-coated carrier particles were either preconditioned in the absence of toner or blended with toner particles and thereafter preconditioned to prepare developer. Preconditioning of carrier and developers was accomplished by, for example, as set forth in the Example II.

EXAMPLE II

Preconditioning and Evaluation of Coated Carrier of Example I; Comparison with Unconditioned Carrier and Developer Two 16-hour aging trials were performed in an hybrid-scavengeless-development(HSD) aging fixture having a development system similar to those found in commercially available copiers or printers, for example, the Xerox Corporation Model DOCUMENT CENTRE® 265. Toner throughput was set at a value of about 2.5 grams per minute. The process speed was equivalent to about 65 copies per minute. The toner concentration was maintained at a level of about 4 weight percent during the trials; and developer samples were removed periodically to measure the developer conductivity. Conductivity was measured on both the toned samples and on detoned samples after removing the toner by means of an air stream. An electrostatic voltmeter was used to monitor reload by measuring the potentials over the donor roller after many passes of the donor roller member past the magnetic brush and also on the first pass after the donor was cleaned by reversing the direct current bias on the roller. Reload was calculated by dividing the potential of the toner layer after one pass over the potential after many passes.

In the two aging trials, the toner materials were identical, the carriers were also identical except that one carrier was preconditioned and the comparison carrier was not preconditioned. Fresh or unconditioned carriers of this type were too insulating to provide good reload performance. After mixing the carrier in a development fixture described above, or in a commercial copier/printer developer housing, the carrier became more conductive and reload performance improved. The preconditioned carrier was made from the same batch of carrier used for the non-preconditioned carrier trial. The carrier was preconditioned by tumbling for six hours in a Littleford M-5-G blender, then very fine particles were removed in a de-dusting operation which consisted of removing fines by placing the preconditioned mixture on an 8 inch screen with 35 micron diameter openings then vacuuming away the fines from the side opposite the developer until no more fines could be removed from the sample wherein a dedusted carrier remains, for example, 1,000 grams of coated carrier was processed in this manner.

FIG. 1 shows conductivity measurements made on detoned developers from the two trials. The unconditioned or non-preconditioned carrier was initially very insulating, but the conductivity increased rapidly at first and then increased more slowly to above about $2\times10^{-13}$ (ohm-cm)$^{-1}$ after about 10 hours. Although not wanting to be limited by theory it is believed that the unpreconditioned carrier (20) becomes more conductive with run time because of a slight loss of the polymer coating, particularly on asperities or spicules, that is projections from the core particle surface, thereby facilitating inter-core particle contacts or alternatively allowing direct core-to-core contacts. The conductivity of the preconditioned carrier (10) was initially about $6\times10^{-11}$ (ohm-cm)$^{-1}$ but decreased to about $4\times10^{-13}$ (ohm-cm)$^{-1}$. Although not wanting to be limited by theory it is believed that the conductivity decrease or loss of the preconditioned carrier may be the result of rapid accumulation or build up of toner material on the areas denuded in the preconditioning step, which build up phenomena is known as impaction. However, the conductivity values of both the preconditioned and unconditioned carriers approach near-optimum reload behavior after an extended time period. The rapid decline in conductivity of the preconditioned carrier was unexpected as was the subsequent rapid stabilization or equilibration at a conductivity level which was highly desirable for efficient reload.

Figure 2:
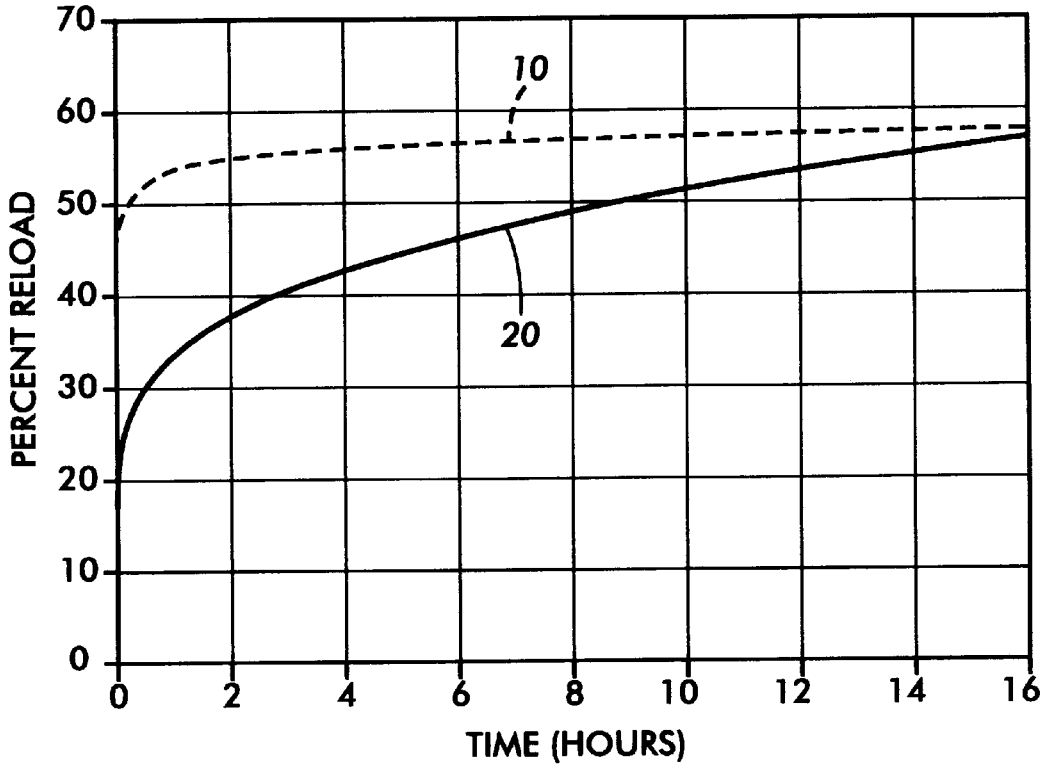
FIG. 2 shows the percent reload or reload efficiency over time of developer containing preconditioned carrier particles of the present invention compared to developer containing unconditioned carrier particles.

As shown in FIG. 2, reload with the preconditioned carrier (10) was about 48 percent and near a steady-state value of about 58 percent initially, whereas reload of the unconditioned carrier (20) was initially very low, about 12 to about 38 percent during the first two hours and required greater than about 14 hours before a steady-state reload was achieved. Thus, the preconditioned carrier was successful in providing excellent reload behavior from the beginning of the trial, whereas the unconditioned carrier was notably deficient in this respect.

Other modifications of the present invention may occur to one of ordinary skill in the art based upon a review of the present application and these modifications, including equivalents thereof, are intended to be included within the scope of the present invention.

What is claimed is:

1. A process comprising:

blending resin coated carrier particles;

separating the resulting blended carrier particles from fine particles formed while blending; and blending the blended carrier particles with toner particles to form a two component developer.

2. A process in accordance with claim 1, wherein blending of the resin coated carrier particles is accomplished in about 5 minutes to about 4 hours and which blending removes metallic asperities and resin coating from the surface thereof and provides preconditioned carrier particles, and wherein blending with toner is accomplished at from about 5 minutes to about 4 hours to achieve a preconditioned carrier conductivity value of from about $10^{-12}$ (ohm-cm)$^{-1}$ to about $10^{-7}$ (ohm-cm)$^{-1}$.

3. A process in accordance with claim 1, wherein blending of coated carrier particles is accomplished with a low or high energy mixer, and wherein the separating of the resulting blended carrier particles from fine particles is accomplished with a vibrating screener.

4. A process in accordance with claim 1, wherein the fine particles comprise particulates of from about 0.1 microns to about 5.0 microns and which particulates arise from the metallic asperities and resin coating being removed from the surface of the coated carrier particles.

5. A process in accordance with claim 1, wherein the developer has an improved reload efficiency at time zero as determined by improved and substantially constant printed image density and donor potential reload measurements of about 50% to about 100%.

6. A process in accordance with claim 1, wherein the carrier coating comprises from about 0.025 to about 3 weight percent of the carrier particles of a mixture of polymethylmethacrylate and polyester-urethane in a weight ratio of from about 20:80 to about 80:20.

7. A process in accordance with claim 1, wherein the resin coating comprises from about 0.025 to about 3 weight percent of a single thermoplastic polymer.

8. A process comprising:

blending and separating coated carrier particles in accordance with claim 1, and thereafter blending with first toner, wherein the toner blending is accomplished for a period of time sufficient to enable the first toner particles to alter the tribocharging ability of the carrier particles and become embedded on the surface of the carrier coating;

dividing or separating the blend of first toner particles and carrier particles into coarse particles and fine particles; and blending the coarse particles with second toner particles to form a two component developer.

9. A process in accordance with claim 8, wherein the developer has an improved reload efficiency at time zero as determined by improved and substantially constant printed image density and donor potential reload measurements of about 50% to about 100%.

10. A process in accordance with claim 8, wherein blending of coated carrier particles with said first toner particles is for a period of time of from about 5 to about 60 minutes.

11. A process in accordance with claim 8, wherein dividing the blend of first toner particles and coated carrier particles is accomplished with a mixed particle size vibrating screener and wherein the coarse particles are from about 10 to about 100 microns.

12. A process in accordance with claim 8, wherein the blending of the coarse particles with said second toner particles to form a two component developer is accomplished with high or low intensity mixer for a period of time of from about 2 to about 20 minutes.

13. A process in accordance with claim 8, wherein the carrier coating is a polymer selected from the group consisting of polyesters, polyester-urethanes, polyurethanes, cross-linked polyurethanes, polymethylmethacrylates, fluorinated polymers, polystyrenes, styrene-acrylate copolymers, and mixtures thereof.

14. A process in accordance with claim 8, wherein the carrier coating is a polyester-urethane polymer.

15. A process in accordance with claim 8, wherein the carrier coating further comprises conductive and non conductive additives selected from the group consisting of colored and colorless pigments, fillers, dye compounds, and mixtures thereof.

16. A process in accordance with claim 8, wherein the carrier coating comprises from about 0.025 to about 3 weight percent of the carrier particles of a mixture of polymethylmethacrylate and polyester-urethane in a weight ratio of from about 20:80 to about 80:20.

17. A process in accordance with claim 8, wherein said first toner particles comprise from about 0.1 to about 10 weight percent of the total weight of the carrier particles and comprise finely divided toner particles with a volume average diameter of from about 3 to about 30 microns.

18. A process in accordance with claim 8, wherein the first toner is selected in an amount of from about 0.1 to about 10 weight percent, and the second toner is selected in an amount of from about 0.1 to about 10 weight percent.

19. A process in accordance with claim 8, wherein said first and second toner can further comprise a charge additive present in an amount of from about 0.05 to about 5 weight percent based on the weight of the toner, and wherein said first and second toner have an admix time of from about 1 to about 14 seconds and a triboelectric charge of from about 10 to about 40 microcoulombs per gram and wherein the developer has a conductivity of from about $10^{-12}$ (ohm-cm)$^{-1}$ to about $10^{-7}$ (ohm-cm)$^{-1}$.

20. A process comprising:

mixing carrier;

separating the resulting carrier from the fine particles formed thereby; and blending the resulting carrier with toner.

21. An imaging process comprising providing a carrier obtained in accordance with the process of claim 20 in a conductive magnetic brush development system, wherein development from a first imaging use or time zero (t=0) use provides excellent image fill.

* * * * *